US008272376B2

(12) United States Patent
Ma et al.

(10) Patent No.: US 8,272,376 B2
(45) Date of Patent: Sep. 25, 2012

(54) GAS COOKER CONTROL SYSTEM

(75) Inventors: Fei Ma, Guangdong (CN); Fujun Cao, Guangdong (CN); Jianwei Liu, Guangdong (CN); Zhaobing Shou, Guangdong (CN)

(73) Assignee: Shenzhen H & T Intelligent Control Co., Ltd., Shenzhen, Guangdong (CN)

( * ) Notice: Subject to any disclaimer, the term of this patent is extended or adjusted under 35 U.S.C. 154(b) by 179 days.

(21) Appl. No.: 12/529,746

(22) PCT Filed: Apr. 25, 2008

(86) PCT No.: PCT/CN2008/070797

§ 371 (c)(1),
(2), (4) Date: Sep. 3, 2009

(87) PCT Pub. No.: WO2009/079931

PCT Pub. Date: Jul. 2, 2009

(65) Prior Publication Data

US 2010/0288262 A1 Nov. 18, 2010

(30) Foreign Application Priority Data

Dec. 21, 2007 (CN) ..... 2007 1 0125428
Jan. 30, 2008 (CN) ..... 2008 1 0066001
Jan. 31, 2008 (CN) ..... 2008 2 0091992 U

(51) Int. Cl.
*F24C 3/00* (2006.01)
*F23N 5/00* (2006.01)
*F23C 3/00* (2006.01)

(52) U.S. Cl. ..... 126/39 BA; 431/72; 431/78

(58) Field of Classification Search ..... 126/39 BA; 431/72, 78
See application file for complete search history.

(56) References Cited

U.S. PATENT DOCUMENTS 3,958,126 A * 5/1976 Bryant ..... 250/554
4,125,357 A * 11/1978 Kristen et al. ..... 431/78
4,235,586 A * 11/1980 Hirsch ..... 431/71
4,319,873 A * 3/1982 Michaud et al. ..... 431/24
4,543,055 A * 9/1985 Tilly ..... 431/12
4,606,719 A * 8/1986 Mori et al. ..... 431/63
4,622,005 A * 11/1986 Kuroda ..... 431/78
4,986,468 A * 1/1991 Deisinger ..... 236/21 R
5,549,469 A * 8/1996 Wild et al. ..... 431/75
5,655,900 A * 8/1997 Cacciatore ..... 431/70
5,957,679 A * 9/1999 Cacciatore ..... 431/18
2010/0236538 A1 * 9/2010 Wah et al. ..... 126/39 BA

* cited by examiner

*Primary Examiner* — Kenneth Rinehart
*Assistant Examiner* — William Corboy
(74) *Attorney, Agent, or Firm* — Jackson IPG PLLC

(57) ABSTRACT

A gas cooker control system includes an ignition controller including a touch button, a resistor, a first comparator, a second comparator and a third comparator, one end of the touch button connected to external power source, and the other end connected to first inputs of the first, second and third comparators, the resistor being connected between the inputs of the first, second and third comparators and ground, outputs of the first, second and third comparators being connected to an igniter, a gas valve and a system power source; a gas valve controller including a switch circuit connected to a power source, at least one gas valve circuit connected between the switch circuit and ground, and a protection circuit parallel to the at least on gas valve circuit; and a power and ignition controller driving device including a power source driving circuit, an ignition driving circuit and a comparison circuit.

12 Claims, 6 Drawing Sheets

GAS COOKER CONTROL SYSTEM

BACKGROUND OF THE INVENTION

1. Field of the Invention

The present invention relates to gas cooker control systems, and more particularly to a gas cooker control system with an efficient ignition controller.

2. Description of the Related Art

Generally, normal gas cookers use mechanical devices to open the gas valve and control the igniter. However, the igniter usually needs an additional battery to provide power supply to the discharging terminal, which could be a waste of resources and pollution of the environment. Moreover, the mechanical control of the gas valve is too complicated in operation.

Thus, circuits are designed to control the use of ignition of gas cooker. Patent ZL91209131.2 issued on Jan. 22, 1992 with issue No. CN2093978U discloses a gas cooker igniter using AC power source. Referring to FIG. 1, an ignition circuit is constituted by a power switch K1, a power indicator Z, a fuse R0, a capacitor C, a diode D, an ignition button switch K2 and step-up transformer B. When the power switch K1 is switched on, a 220V AC power is applied to the ignition circuit. The ignition button K2 has a contact K2-1 switched on and a contact K2-2 switched off. The 220V AC power charges the capacitor C through the diode D. When the ignition button K2 is pushed, the contact K-1 is switched off, the 220V AC power is cut off, and the contact K-2 being switched on. The capacitor C discharges through a primary winding L1 of the step-up transformer B, a secondary winding L2 of the step-up transformer B thereby inducing a high level voltage, thus a discharging terminal connected to the secondary winding L2 generates a spark. At this moment, if the gas valve is open, the gas cooker is ignited.

Although the above-mentioned gas cooker use AC power to be ignited while no batteries is needed, the power source, the igniter and the gas valve are controlled separately, a user needs to manually press the power switch K1 to connect the power source, and to manually press the ignition button to ignite, with the gas valve open beforehand. Therefore, the operation of ignition of the gas cooker is still very complicated and without linkage of work of the power source, the igniter and the gas valve. Moreover, because it needs the gas valve open beforehand, a potential safety hazard occurs.

Referring to FIG. 2, power source and igniter of conventional gas cookers are driven by mechanical switches controlling circuits including igniter circuit and power circuit to enable a load, therefore, achieving the purpose of ignition. However, this kind of circuits is low in efficiency and insecure. Thus more efficient and easy operation circuits for power source and igniter of gas cookers are in need.

Traditional gas cookers that have mechanical gas valve control are not safe enough, and some have thermoelectric couple for power supply which needs holding the gas valve at the beginning of ignition for the thermoelectric couple to generate current high enough. However, the above-mentioned gas cooker is not capable of keeping the gas valve open and manual operation is a must, which is inconvenient and not safe.

What is needed, therefore, is a gas cooker that can overcome the above-described deficiencies.

SUMMARY OF THE INVENTION

It is a object of the present invention to provide an igniter controller to overcome the aforementioned disadvantages.

It is another object of the present invention to provide a gas valve controller to overcome the aforementioned disadvantages.

It is another object of the present invention to provide a power and ignition controller driving device to overcome the aforementioned disadvantages.

In one exemplary embodiment of the present invention is a gas cooker control system includes an ignition controller comprising a touch button, a resistor, a first comparator, a second comparator and a third comparator, the touch button comprising an end connected to external power source, and the other end connected to first inputs of the first, second and third comparators, the resistor being connected between the inputs of the first, second and third comparators and ground, second inputs of the first, second and third comparators being configured for providing a first reference voltage, a second reference voltage and a third reference voltage respectively, outputs of the first, second and third comparators being connected to an igniter, a gas valve and a system power source, a voltage of the external power source being greater than the first reference voltage, the first reference voltage being greater than the second reference voltage, the second reference voltage being greater than the third reference voltage; a gas valve controller including a switch circuit connected to a power source, at least one gas valve circuit connected between the switch circuit and ground, and a protection circuit parallel to the at least on gas valve circuit, the switch circuit being configured for controlling the on or off of the power source and further controlling the at least one gas valve circuit; and a power and ignition controller driving device including a power source driving circuit, an ignition driving circuit and a comparison circuit connected between the power source driving circuit and the ignition circuit, the comparison circuit being configured for providing a high level voltage or a low level voltage to control the power source driving circuit and the ignition driving circuit according to an input of delay voltage signal.

Other novel features and advantages will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF PREFERRED EMBODIMENTS

Reference will now be made to the drawings to describe preferred and exemplary embodiments in detail.

Figure 1:
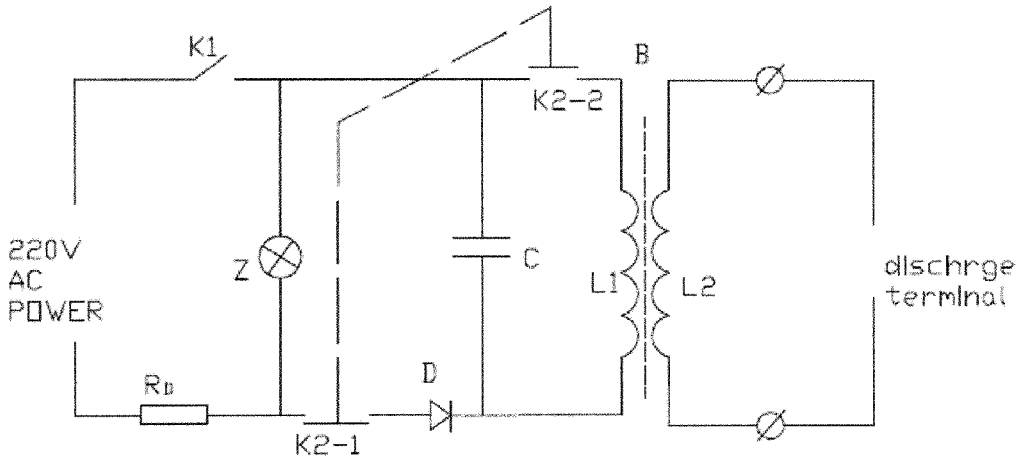
FIG. 1 is a circuit diagram of a conventional gas cooker igniter.
Figure 2:
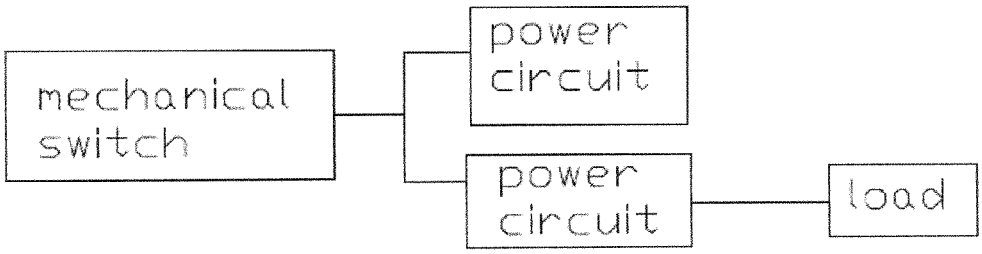
FIG. 2 is a block diagram of a conventional gas cooker power source circuit and igniter circuit.
Figure 3:
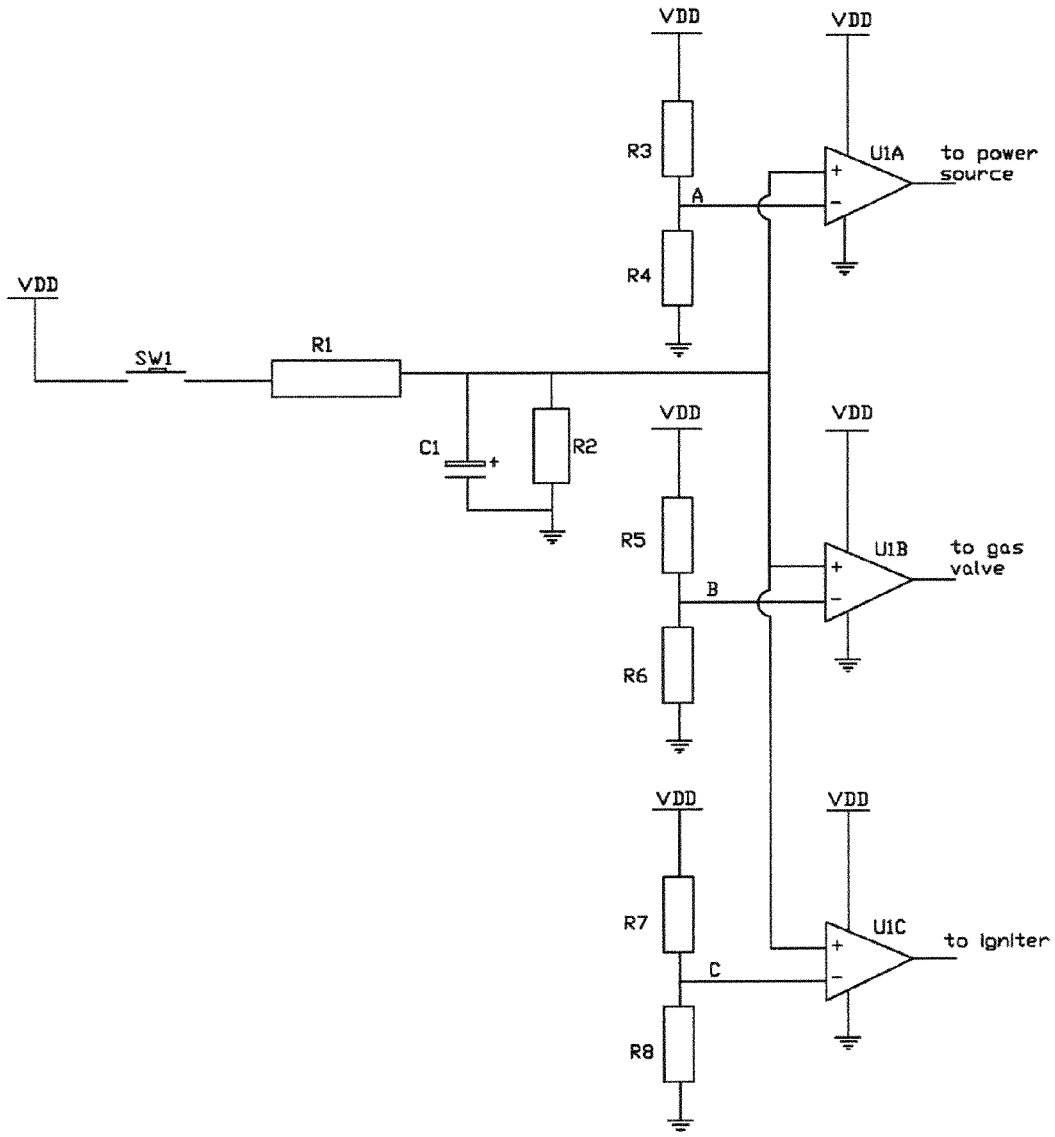
FIG. 3 is a circuit diagram of an ignition controller of a gas cooker according to an exemplary embodiment of the present invention, the ignition controller including a capacitor.

Referring to FIG. 3, a circuit diagram of an ignition controller of a gas cooker according to an exemplary embodiment of the present invention is shown. The ignition controller includes a touch button SW1, a plurality of resistors R1~R8, a capacitor C1, and a first comparator U1A, a second capacitor U1B and a third comparator U1C. The touch button SW1 has an end connected to external power source VDD, such as a 5V voltage source, configured to control the igniter controller to be power on or off. The other end of the touch button SW1 is connected to the "+" inputs of the first comparator U1A, the second comparator U1B and the third comparator U1C configured to provide a first input voltage, a second input voltage and a third input voltage thereto, respectively. The capacitor C1 and the resistor R2 is parallel connected such that constitute a parallel branch which has one end connected to the "+" inputs of the comparators U1A, U1B and U1C, and the other end connected to ground, thereby forming a charge-discharge loop circuit. The resistor R1 is connected between the touch button SW1 and the capacitor C1 served as a divider resistor.

The first comparator U1A has a negative input "−" connected to a node A between two serial divider resistors R3 and R4, and the divider resistor R3 is connected to the external voltage source VDD and the divider resistor R4 is connected to ground. The serial divider resistors R3 and R4 are configured to provide a first reference voltage Ua (namely voltage at node A) to the first comparator U1A. The first comparator U1A can compare the first input voltage of the input "+" and the first reference voltage of the input "−" and output a high level voltage or a low level voltage to power source so as to control the power source of the gas cooker to be turned on or turned off. For example, when the first input voltage of the input "+" is greater than the first reference voltage of the input "−", the first comparator U1A outputs a high level voltage such that the power source is turned on. When the first input voltage of the input "+" is less than the first reference voltage of the input "−", the first comparator U1A outputs a low level voltage such that the power source is turned off to avoid an incorrect manipulation.

The second comparator U1B has a negative input "−" connected to a node B between two serial divider resistors R5 and R6, and the divider resistor R5 is connected to the external voltage source VDD and the divider resistor R6 is connected to ground. The serial divider resistors R5 and R6 are configured to provide a second reference voltage Ub (namely voltage at node B) to the second comparator U1B. The second comparator U1B can compare the second input voltage of the input "+" and the second reference voltage of the input "−" and output a high level voltage or a low level voltage to the gas valve so as to control the gas valve of the gas cooker to be open or close. For example, when the second input voltage of the input "+" is greater than the second reference voltage of the input "−", the second comparator U1B outputs a high level voltage such that the gas valve is open. When the second input voltage of the input "+" is less than the second reference voltage of the input "−", the second comparator U1B outputs a low level voltage such that the gas valve is close. When the second comparator U1B control the gas valve to be close, other techniques can be adopted to maintain the gas valve open. For example, employing a transducer, such like a thermoelectric couple, to provide a maintain current.

The third comparator U1C has a negative input "−" connected to a node C between two serial divider resistors R7 and R8, and the divider resistor R7 is connected to the external voltage source VDD and the divider resistor R8 is connected to ground. The serial divider resistors R7 and R8 are configured to provide a third reference voltage Uc (namely voltage at node C) to the third comparator U1C. The third comparator U1C can compare the third input voltage of the input "+" and the third reference voltage of the input "−" and output a high level voltage or a low level voltage to the igniter so as to control the igniter of the gas cooker to be activated or not activated. For example, when the third input voltage of the input "+" is greater than the third reference voltage of the input "−", the third comparator U1C outputs a high level voltage such that the igniter is activated. When the third input voltage of the input "+" is less than the third reference voltage of the input "−", the third comparator U1C outputs a low level voltage such that the igniter is not activated.

The touch button SW1 is turned on when being touched, and turned off when touch is off. There is a certain response period of time for a user to touch the button, 15 ms for example, when the user touches the touch button SW1. During the response period of time, the igniter controller is powered on, the capacitor C1 is charged. A resistance of the resistor R1 is configured to make sure the capacitor C1 can be fully charged during the response period of time. The resistance of the resistor R1 usually can be within a scope of 100~700Ω.

Figure 4:
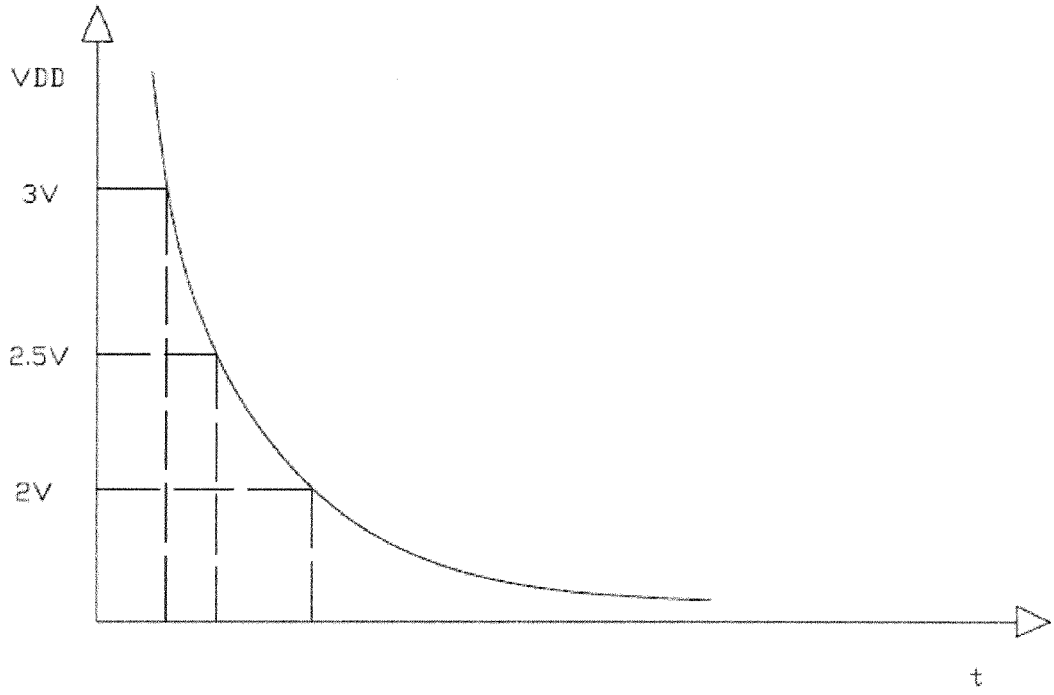
FIG. 4 is a curve graph of the capacitor of the ignition controller shown in FIG. 3.

When the touch button SW1 is turned off, the capacitor C1 discharges through the resistor R2. Referring to FIG. 4, with time growing, a voltage of the capacitor C1 is gradually decreased. To co-control the power source, the gas valve and the igniter of the gas cooker, a relation of the power source voltage VDD, the first reference voltage Ua, the second reference voltage Ub and the third reference voltage Uc can be described as:

$$VDD>Uc>Ub>Ua>0V$$

In the illustrated embodiment, the power source voltage VDD is equal to 5V, the first reference voltage is equal to 2V, the second reference voltage Ub is equal to 2.5V, and the third reference voltage Uc is equal to 3V.

Thus, during the discharging of the capacitor C1, when the voltage of the capacitor C1 is greater than the third reference voltage Uc, the comparator U1A outputs a high level voltage and the power source is turned on. Meanwhile, the second comparator U1B outputs a high level voltage and the gas valve is open, gas is released. The third comparator U1C outputs a high level voltage, the igniter is activated, and thus the gas is ignited. In this case, a complete ignition process is finished.

While the capacitor C1 continues discharging, when the voltage of the capacitor C1 is greater than the second reference voltage Ub and less than the third reference voltage Uc, the third comparator U1C outputs low level voltage, the igniter is shut down. The first and second comparators U1A, U1B continue outputting high level voltage, the power source maintains on state and the gas valve maintains open. When the voltage of the capacitor C1 is greater than the first reference voltage Ua and less than the second reference voltage Ub, the second comparator U1B then outputs a low level voltage and the gas valve is close unless an maintain current is provided by some other transducer. The first comparator U1A outputs the high level voltage, and the third comparator U1C outputs the low level voltage. When the voltage of the capacitor C1 becomes less than the first reference voltage Ua, the first comparator U1A then outputs a low level voltage, the power source is cut off, the gas cooker has completed a whole working process cycle and is prepared for a new instruction (touch on the touch button SW1).

The gas cooker according to an exemplary embodiment of the present invention has the ignition controller to control the power source, the gas valve and the igniter, thus no mechanically switching control and manual operation are needed, which is much more convenient in operation and humanized.

Figure 5:
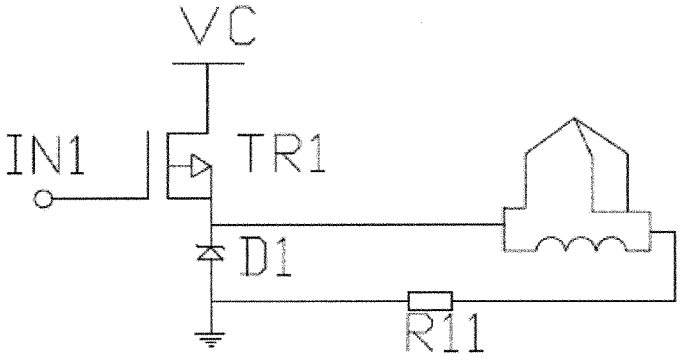
FIG. 5 is a schematic circuitry view of a gas valve controller of a gas cooker according to one embodiment of the present invention.

Referring to FIG. 5, a gas valve controller of the gas cooker includes a switch circuit, a gas valve circuit, and a protection circuit parallel connected with the gas valve circuit. The switch circuit includes a transistor TR1 having a gate electrode connected to an input terminal IN1 receiving an input voltage, a source electrode connected to the gas valve circuit, and a drain electrode connected to power voltage VC. The gas valve circuit includes a gas valve, a thermoelectric couple parallel connected to the gas valve, and a ground resistor R11 serially connected to the gas valve. The protection circuit includes a diode D1 connected between the switch circuit and ground served as a surge voltage suppression diode.

When the input terminal IN1 has a low level voltage applied thereto, the transistor TR1 is switched on. The power voltage VC provides a current that the gas valve can maintain open with the current. If the gas valve is forced to open, the power voltage VC is connected to ground sequentially via the gas valve, the resistor R11, and the thermoelectric couple. After the gas valve is open, the electric energy provided by the power voltage VC is converted into magnetic energy which keeps the gas valve open, and gas can be release. If the igniter is activated, the igniter of the gas cooker ignited. For a consideration of power-saving and safety, the power voltage VC cannot be provided all the time and the gas cannot be released all the time. After a period of time provided with low level voltage, the input terminal IN1 has a high level voltage applied thereto. The transistor TR1 is switched off. Therefore, the current for maintaining the gas valve open should be provided by a transducer, a thermoelectric couple for example, which can generate thermoemf as long as being heated. The diode D1 is configured to suppress a surge voltage between the transistor TR1 and ground, to prevent the surge voltage causes damages to the whole circuits.

Figure 6:
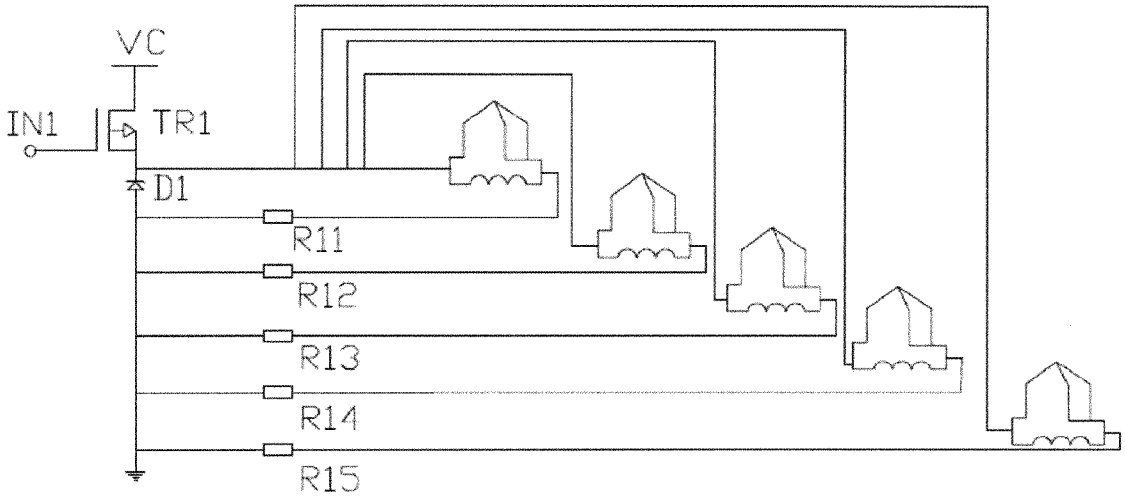
FIG. 6 is a schematic circuitry view of a gas valve controller of a gas cooker according to another embodiment of the present invention.

Referring to FIG. 6, this shows the gas valve controller according to another embodiment, the gas valve controller in FIG. 6 has a similar working principle with the gas valve controller in FIG. 5. However, the gas valve controller has five gas valves which can work both simultaneously or separately. It is merely an alternative embodiment shown in FIG. 6, the number of the gas valves of the gas valve controller is not limited to one or five.

Figure 7:
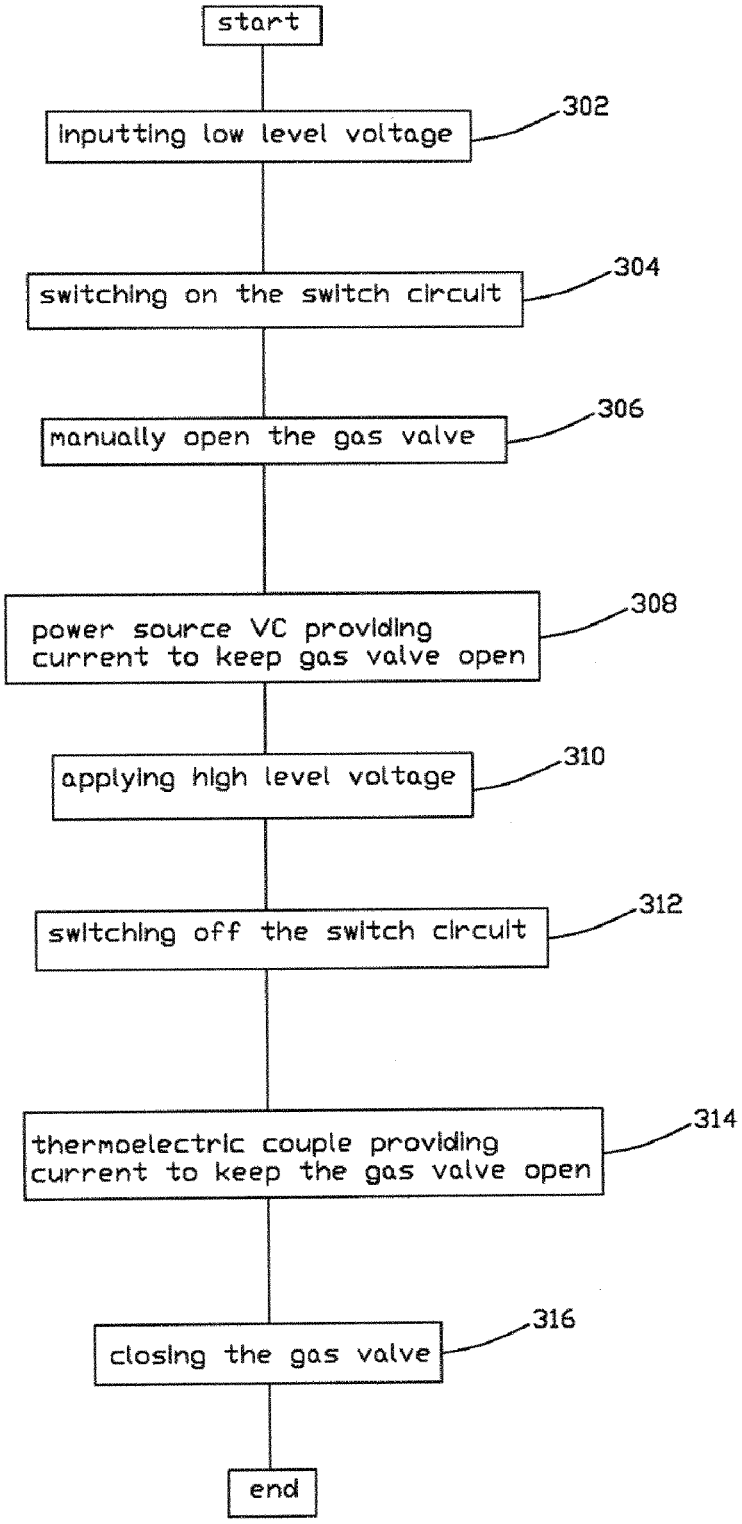
FIG. 7 is a flow chart of a control method of the gas valve of the gas cooker shown in FIG. 5.

Referring to FIG. 7, this shows a flow chart of a control method of the gas valve of the gas cooker shown in FIG. 5. In step 302, the input terminal IN1 is provided with low level voltage. In step 304, the transistor TR1 of the switch circuit is switched on, thus the power source VC, the gas valve, the resistor R11, the thermoelectric couple, and ground constitute a complete circuit. In step 306, the gas valve is manually open, as what have been described above. In step 308, because the switch circuit is switched on, the gas valve maintains open because of a current supplied by the power source VC. In step 310, the input terminal IN1 is applied with a high level voltage. In step 312, the switch circuit is switched off, and the current from the power source VC is cut off. In step 314, the thermoelectric couple provides a current to keep the gas valve open. In step 316, a working cycle is completed when close the gas valve.

Figure 8:
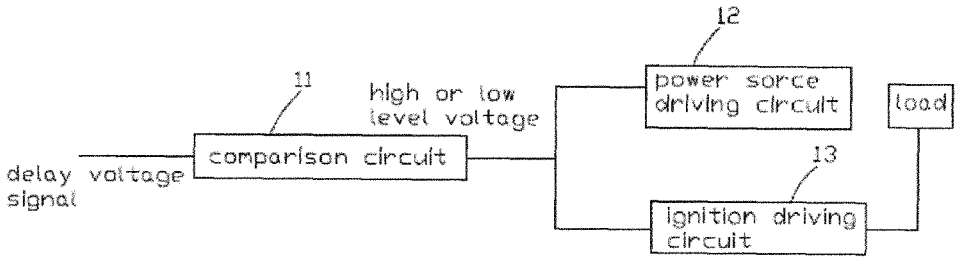
FIG. 8 is a block view of the igniter controller shown in FIG. 7.

Referring to FIG. 8, a power and ignition controller driving device includes a comparison circuit 11, a power driving circuit 12 and an ignition driving circuit 13. The comparison circuit 11 is connected to the power driving circuit 12 and the ignition driving circuit 13, through providing a delay voltage signal to the comparison circuit 11 to generate a voltage level, so as to control the power driving circuit 12 and the ignition driving circuit 13, such that the power is on and the igniter is ignited.

Figure 9:
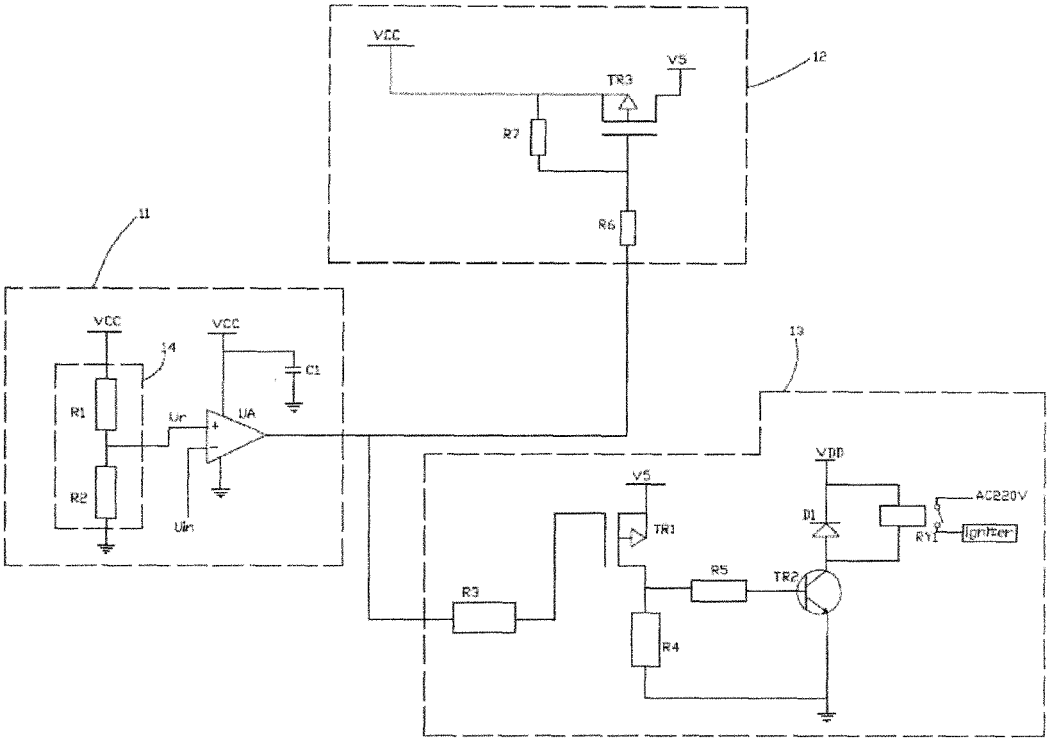
FIG. 9 is a circuit diagram of the igniter controller.

Referring to FIG. 9, the comparison circuit 11 includes a comparator UA connected to the power source VCC and a divider circuit 14 configured to provide a divider voltage Ur. The comparator is configured to comparing the voltage Ur and Uin. The divider circuit 14 includes divider resistors R1, R2, and the comparator UA has a phase input connecting between the resistors R1 and R2. The comparator 11 further includes a capacitor C1 connecting between the power source VCC and ground. The comparator UA has a reverse phase input is connected to a delay voltage signal Uin with delay time T, and the phase input is connected to the voltage Ur, then the comparator UA outputs a high level voltage or a low level voltage. The power driving circuit 12 includes a transistor TR3, a current limiting resistor R6 connected the output of the comparator UA and a gate electrode of the transistor TR3, and a current limiting resistor R7 connected the power source VCC and a source electrode of the transistor TR3. A drain electrode of the transistor TR3 is connected to a load voltage V5, which is configured for control the triode TR2 to be on or off according to an on-state or a off-state of the transistor TR1. The ignition driving circuit 13 includes the transistor TR1, the triode TR2, a diode D1, a relay RY1, a limiting resistor R3 connected between the output of the comparator 11 and the gate electrode of the transistor TR1, a limiting resistor R5 connected between the drain of the transistor TR1 and a base of the triode TR2, and a limiting resistor R4 connected between the drain electrode of the transistor TR1 and an emitter of the triode TR2. The gate electrode of the transistor TR1 is connected to the resistor R3, source electrode connected to the load voltage V5, drain electrode connected to the resistors R4 and R5. The base of the triode TR2 is connected to the resistor R5, collector connected to the diode D1 and the relay RY1, emitter connected to ground. The diode D1 and the relay RY1 are parallel between the power source VDD and the collector of the triode TR2. The diode D1 is configured for preventing a reverse voltage when the relay RY1 is closed.

The voltage signal Uin with delay time T is applied to the reverse phase input of the comparator UA, and the divider voltage Ur divided by the resistors R1, R2 is applied to the phase input of the comparator UA. With the period of the delay time T, if the voltage Uin is greater than the voltage Ur, then the comparison circuit 11 outputs low level voltage, and the transistor TR3 of the power driving circuit 12 is switched on, thus the load voltage is charged from the power source VCC. Meanwhile, the ignition driving circuit 13 has the transistor TR1 and the triode TR2 in on-state, such that the relay RY1 works, the igniter being ignited. After the period of delay time T, if the voltage Uin is less than the voltage Ur, then comparator UA outputs a high level signal, the comparison circuit outputs high level voltage. The transistor TR3 is switched off, and the power source VCC provides no voltage to the load voltage. Meanwhile, the ignition driving circuit 13 has the transistor TR1 and the triode TR2 in off-state, the relay RY1 stop working and the igniter cannot be ignited.

The gas cooker includes the comparison circuit 11, through providing a delay voltage signal to the comparison circuit 11 and outputting low or high level voltages to control the power driving circuit 12 and the ignition driving circuit 13 to achieve the purpose of power on and ignition. The delay time T of the delay voltage signal can be adjusted to precisely control the working time of the power source and the igniter, thus the gas cooker is more intelligent, safer, reliable and efficient.

It is to be understood, however, that even though numerous characteristics and advantages of exemplary and preferred embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gas cooker control system comprising:

an ignition controller comprising a touch button, a resistor, a first comparator, a second comparator and a third comparator, the touch button comprising an end connected to external power source, and the other end connected to first inputs of the first, second and third comparators, the resistor being connected between the inputs of the first, second and third comparators and ground, second inputs of the first, second and third comparators being configured for providing a first reference voltage, a second reference voltage and a third reference voltage respectively, outputs of the first, second and third comparators being connected to an igniter, a gas valve and a system power source, a voltage of the external power source being less than the first reference voltage, the first reference voltage being less than the second reference voltage, the second reference voltage being less than the third reference voltage;

a gas valve controller comprising a switch circuit connected to a power source, at least one gas valve circuit connected between the switch circuit and ground, and a protection circuit parallel to the at least one gas valve circuit, the switch circuit being configured for controlling the on or off of the power source and further controlling the at least one gas valve circuit; and a power and ignition controller driving device comprising a power source driving circuit, an ignition driving circuit and a comparison circuit connected between the power source driving circuit and the ignition circuit, the comparison circuit being configured for providing a high level voltage or a low level voltage to control the power source driving circuit and the ignition driving circuit according to an input of delay voltage signal.

2. The gas cooker control system as claimed in claim 1, wherein further comprises a divider resistor connected between the touch button and the capacitor.

3. The gas cooker control system as claimed in claim 1, wherein the first, second and third comparators each have the second input connected between two serial divider resistors, the two serial divider resistors being connected between the external power source and ground.

4. The gas cooker control system as claimed in claim 1, wherein the first inputs of the first, second, and third comparators are positive inputs "+", respectively.

5. The gas cooker control system as claimed in claim 1, wherein outputs of the first, second, and third comparators are configured to output high level voltages to control the igniter, the gas valve and the system power source, respectively.

6. The gas cooker control system as claimed in claim 1, wherein the switch circuit comprises a transistor, the transistor having a gate electrode receiving input voltage, a source electrode connected to the gas valve circuit and a drain electrode connected to power source.

7. The gas cooker control system as claimed in claim 1, wherein the gas valve circuit comprises a gas valve, thermoelectric couple connected to the gas valve and a resistor serially connected to ground.

8. The gas cooker control system as claimed in claim 1, wherein the protection circuit comprises a surge voltage suppression diode connected between the switch circuit and ground.

9. The gas cooker control system as claimed in claim 1, wherein the comparator circuit comprises a comparator UA connected to a power source VCC, a divider circuit connected to phase input of the comparator UA and a filtering capacitor connected between the power source VCC and ground, the reverse phase input of the comparator UA receiving the delay voltage signal.

10. The gas cooker control system as claimed in claim 9, wherein the divider circuit comprises two divider resistors connected between the power source and ground, the phase input of the comparator UA being connected between the two resistors R1, R2.

11. The gas cooker control system as claimed in claim 1, wherein the power source driving circuit comprises a transistor TR3, a limiting resistor R6 connected between the comparison circuit and a gate electrode of the transistor TR3, and a second limiting resistor connected between the power source and a source of the transistor TR3, a drain of the transistor being connected to a load voltage V5.

12. The gas cooker control system as claimed in claim 1, wherein the ignition driving circuit comprises a transistor TR1, a triode TR2, a diode D1, a relay RY1, a limiting resistor R3 connected between the output of the comparator and the gate electrode of the transistor TR1, a limiting resistor R5 connected between the drain of the transistor TR1 and a base of the triode TR2, and a limiting resistor R4 connected between the drain electrode of the transistor TR1 and an emitter of the triode TR2, a gate electrode of the transistor TR1 being connected to the resistor R3, source electrode being connected to the load voltage V5, drain electrode being connected to the resistors R4 and R5, the base of the triode TR2 being connected to the resistor R5, collector being connected to the diode D1 and the relay RY1, emitter being connected to ground, the diode D1 and the relay RY1 being parallel between the power source VDD and the collector of the triode TR2.

* * * * *